US006460827B1

(12) United States Patent
Baucom

(10) Patent No.: US 6,460,827 B1
(45) Date of Patent: Oct. 8, 2002

(54) PNEUMATIC LIFT AND MOVEMENT SYSTEM FOR SHELVING

(76) Inventor: David A. Baucom, 4203 Maplecross, Pasadena, TX (US) 77505

( * ) Notice: Subject to any disclaimer, the term of this patent is extended or adjusted under 35 U.S.C. 154(b) by 0 days.

(21) Appl. No.: 09/544,775

(22) Filed: Apr. 7, 2000

(51) Int. Cl.[7] ..... B66F 5/04

(52) U.S. Cl. ..... 254/2 R; 254/89 M; 254/134

(58) Field of Search ..... 254/2 R, 2 B, 254/2 C, 93 HP, 45, 134, 89 R, 89 H; 269/17

(56) References Cited

U.S. PATENT DOCUMENTS

| | | | | |
|---|---|---|---|---|
| 3,010,698 A | | 11/1961 | Allen et al. | |
| 3,326,311 A | | 6/1967 | Jung | |
| 3,719,299 A | * | 3/1973 | Oehler | 254/93 HP |
| 3,949,976 A | * | 4/1976 | Cofer | 269/17 |
| 4,123,038 A | * | 10/1978 | Meyers | 254/2 R |
| 4,461,455 A | | 7/1984 | Mills et al. | |
| 4,470,578 A | | 9/1984 | Arvidsson et al. | |
| 4,934,893 A | | 6/1990 | Johnson | |
| 5,411,360 A | | 5/1995 | Hilliker et al. | |
| 5,427,494 A | | 6/1995 | Fitzgerald | |
| 5,944,474 A | | 8/1999 | Cummins et al. | |

OTHER PUBLICATIONS

"Aetnastak Shelving for Today's Library," Montel, Inc., 1995.

* cited by examiner

*Primary Examiner*—Robert C. Watson
(74) *Attorney, Agent, or Firm*—Andrews, Kurth, Mayor, Day, Caldwell & Keeton, L.L.P.

(57) ABSTRACT

A lifting and movement system for lifting a complete run of shelving having a plurality of shelf units and for moving the shelving along a floor surface to a desired location. First and second frame structures are defined by interconnected modular frame assemblies so as to have sufficient length to extend along the entire length of a run of shelving. Wheels such as casters are mounted to the first frame to provide for movement of the lifting system and the run of shelving along the floor surface to a desired location. A second, movable frame is in vertically movable assembly with the first frame and has shelving engaging components for lifting engagement with the run of shelving. A plurality of lift elements are supported by the first frame and provide support for the second frame and the shelving engaged thereby. A power system, which is preferably a pneumatic pressure supply is in controllable relation with each of the lift elements and is selectively actuatable for simultaneously activating each of the lift elements for simultaneous lifting or lowering of all of the modular sections of the second frame relative to the first frame to thereby provide for selective lifting or lowering the shelving.

10 Claims, 5 Drawing Sheets

PNEUMATIC LIFT AND MOVEMENT SYSTEM FOR SHELVING

BACKGROUND OF THE INVENTION

1. Field of the Invention

This invention relates generally to lift devices and more specifically concerns lift and movement systems for lifting shelving, particularly shelving in its loaded condition, to minimize the labor requirements for activities such as carpet or flooring replacement in libraries where books and the like are supported by shelving. Even more specifically, the present invention concerns lift and movement systems for loaded shelving, which enable the lifting and moving of an entire "run" of shelving which is made up by a number of shelving units which are located in side-by-side typically abutting relation.

2. Description of the Prior Art

Typically in libraries, but also in other environments a plurality of shelving units are often placed in side-by-side, typically abutting relation to define a run of shelving. Each of the shelving units may be composed of metal or wood or a combination of such materials and typically are provided with a plurality of vertically spaced generally horizontally oriented shelves for the support of books or other objects.

When it becomes desirable to move the shelving, such as for carpet repair or replacement, floor maintenance or for any other purpose the shelving is typically unloaded of its supported contents which must then be stored in orderly fashion until the supported contents can be replaced on the shelving. Significant labor is typically required for shelf unloading and packaging of the contents of the shelving and, after replacement or relocation of the shelving, for again placing the contents in proper order on the shelving. It is desirable therefore, to provide a system for lifting the shelving, while loaded, and then moving the lifted shelving to a desired location to permit floor service work to be accomplished and, after completion of the floor service work, to return the lifted loaded shelving to its desired location and lower it onto the carpet or other floor surface.

Shelving is often installed in spaced rows or "runs" in libraries and other facilities to enable personnel to walk between the runs of shelving for access to individual selected items that are supported by the shelving. When shelving is to be moved to permit floor service work to be done, it is desirable to provide a system for lifting complete runs of shelving and moving the lifted run of shelving to an out-of-the-way location or to any other suitable location. Thus, it is desirable to provide a lifting and movement system which accomplishes simultaneous lifting of each of the individual shelving units that make up a complete run of shelving and also facilitates efficient movement of the entire run of shelving without damaging the shelving units or their contents in any manner whatever.

Though shelving units are typically capable of supporting significantly heavy loads of items such as books, equipment, boxes, etc. they typically have minimal lateral strength. Thus, when a shelving unit is being lifted, if the lift is not conducted evenly along the entire lower structure of the shelving unit, the shelving unit can become twisted to the point that it can become damaged. Thus, whether lifting independent shelving units or lifting an entire run of shelving having a number of shelving units, it is critical that simultaneous and even lifting be accomplished.

SUMMARY OF THE INVENTION

It is a principal feature of the present invention to provide a novel lift and movement system having the capability for lifting a complete run of shelving, even when the shelving is loaded, thereby enabling the shelving to be moved to a different location;

It is another feature of the present invention to provide a novel lift and movement system for handling shelving, which permits simultaneous lifting of a number of independent shelving units that make up a run of shelving to thus enable simultaneous movement of the shelving units as a run of shelving;

It is another feature of the present invention to provide a novel lifting and movement system for shelving which may include multiple lifting devices of pneumatic, hydraulic, mechanical or electromechanical character to provide for simultaneous lifting and movement of the multiple shelf units of a run of shelving;

It is another feature of the present invention to provide a novel lifting and movement system for shelving which can be set up in any suitable length to thus enable the lifting and movement of a run of shelving of a particular length;

It is also a feature of the present invention to provide a novel lift and movement system for shelving that is of portable nature and can be moved from place to place in assembled, disassembled or connectable unit form to enable efficient use thereof;

It is an even further feature of the present invention provide a novel lift and movement system for shelving which is of simple nature, is reliable in use and low in cost;

It is also a feature of the present invention to provide a novel lifting and movement system for shelving which enables efficient lifting and movement of runs of shelving by a minimal number of workers, thereby ensuring efficient and low cost movement of the shelving;

It is another feature of the present invention to provide a novel lifting and movement system for shelving which is designed and incorporated modular adjustable units to enable use thereof with a wide range of shelving having a wide range of widths and heights; and It is also a feature of the present invention to provide a novel lifting and movement system for shelving which incorporates a wheel supported frame and a load supporting frame being disposed in substantially vertically movable relation with the wheel supported frame and further incorporated guide means for guiding movement of the load supporting frame relative to the wheel supported frame;

Briefly, the various objects and features of the present invention are realized through the provision of a lift and movement system which can be of modular form enabling assembly of a desirable number of modular lifting units to define a shelving lift and movement system of suitable length for lifting and moving an entire run of shelving regardless of the number of shelving units in the run. Each of the modular units of the shelving lift and movement system incorporates an adjustable frame structure having a pair of vertical posts that define internal guide channels and have casters or any other suitable type of roller affixed to the lower ends thereof so as to provide for movement of shelving after the shelving has been raised a suitable distance from a floor surface on which it otherwise rests. Horizontally oriented structural members are interconnected with one another and also interconnected with adjacent lifting posts. Upper horizontally oriented structural members are also interconnected to one another and are provided with guide roller sets at the respective ends thereof which are received by the internal guide channels of the lifting posts. These upper horizontal members are also provided with transverse structural members which provide support for shelf engaging elements. A plurality of lifting elements are supported by lift supports that are fixed to the respective lifting posts. These lift devices, which are preferably pneumatic lift devices, may also take any other suitable form such as, for example, hydraulic lift devices, mechanically operated lift devices or electromechanical lift devices such as lifts driven by electric motors. It is important that the multiple lift devices have the capability for simultaneously applying equal lifting force to the moveable horizontal members to thereby provide for simultaneously and even lifting of all of the multiple shelving units that make up a run of shelving.

When the shelving units have been raised clear of the floor surface on which they previously rested, the shelving units will be supported by a plurality of casters or rollers that are provided at the lower ends of each of the lifting posts. With shelving so raised, only one or two workers are needed to move the raised run of shelving from the floor surface and move it to a desired location. Typically, the shelving of libraries, retail stores, manufacturing facilities and the like may be moved to an out of the way position to thereby enable such activities as replacement of carpet, repair of floor services, etc. When carpet replacement activities are in progress typically the loaded shelving is raised, moved to an out of the way position, and after the new carpet has been laid, the shelving is rolled back into its proper position and then is lowered onto the carpet. Obviously, the apparatus of the present invention is capable of lifting and movement of many other types of shelving and is also capable of lifting and moving devices and structures other than shelving.

Many of the structural components that make up the lifting and moving apparatus of the present invention are of adjustable length or height and various components may be mounted at various locations to facilitate an efficient and stable fit of the lifting and movement apparatus with a wide variety of shelving of widely differing dimensions. Thus, though the invention is described herein particularly as it pertains to lifting and movement of runs of shelving, it should be borne in mind that such discussion is not intended to limit the spirit and scope of the present invention in any matter whatever.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof It is to be noted however, that the appended drawings illustrate only a typical embodiment of this invention and are therefore not to be considered limiting of its scope, for the invention may admit to other equally effective embodiments.

In the Drawings.

DETAILED DESCRIPTION OF PREFERRED EMBODIMENT

Figure 1:
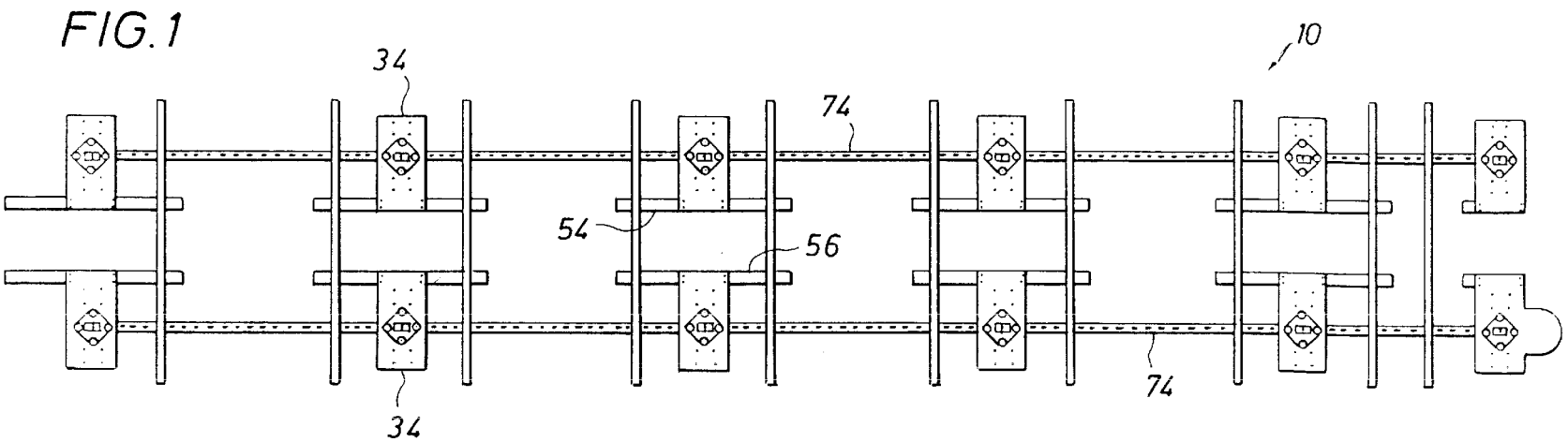
FIG. 1 is a plan view of a lift and movement system for shelving which is construction in accordance with the principles of the present invention and is adapted for lifting and movement of an entire run of shelving.
Figure 2:
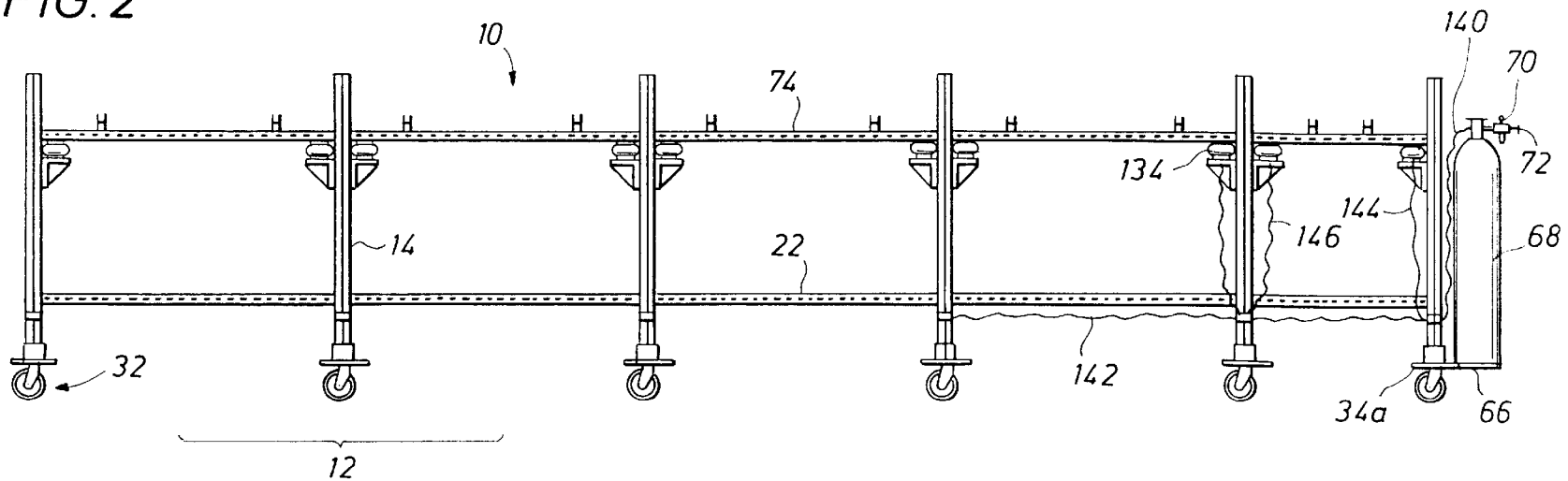
FIG. 2 is a side elevational view of the shelving lift and movement system of FIG. 1.

Referring now to the drawings and first to FIGS. 1 and 2, the shelf lift and movement assembly is shown generally at 10, which has the capability for lifting an entire run of shelving, even when the shelving is loaded and supporting the shelving on a plurality of casters or other types of wheels to thereby enable the lifted shelving to be moved to a desired location. The shelving lift and movement system 10 is defined by a plurality of interconnected shelving lift and movement modules that are interconnected to establish a shelving lift and movement system of suitable length for lifting and movement of an entire run of shelving, including multiple shelving units. Each of the regular modular shelving lift and movement units is particularly of the form identified at 12 in FIG. 2.

Figure 3:
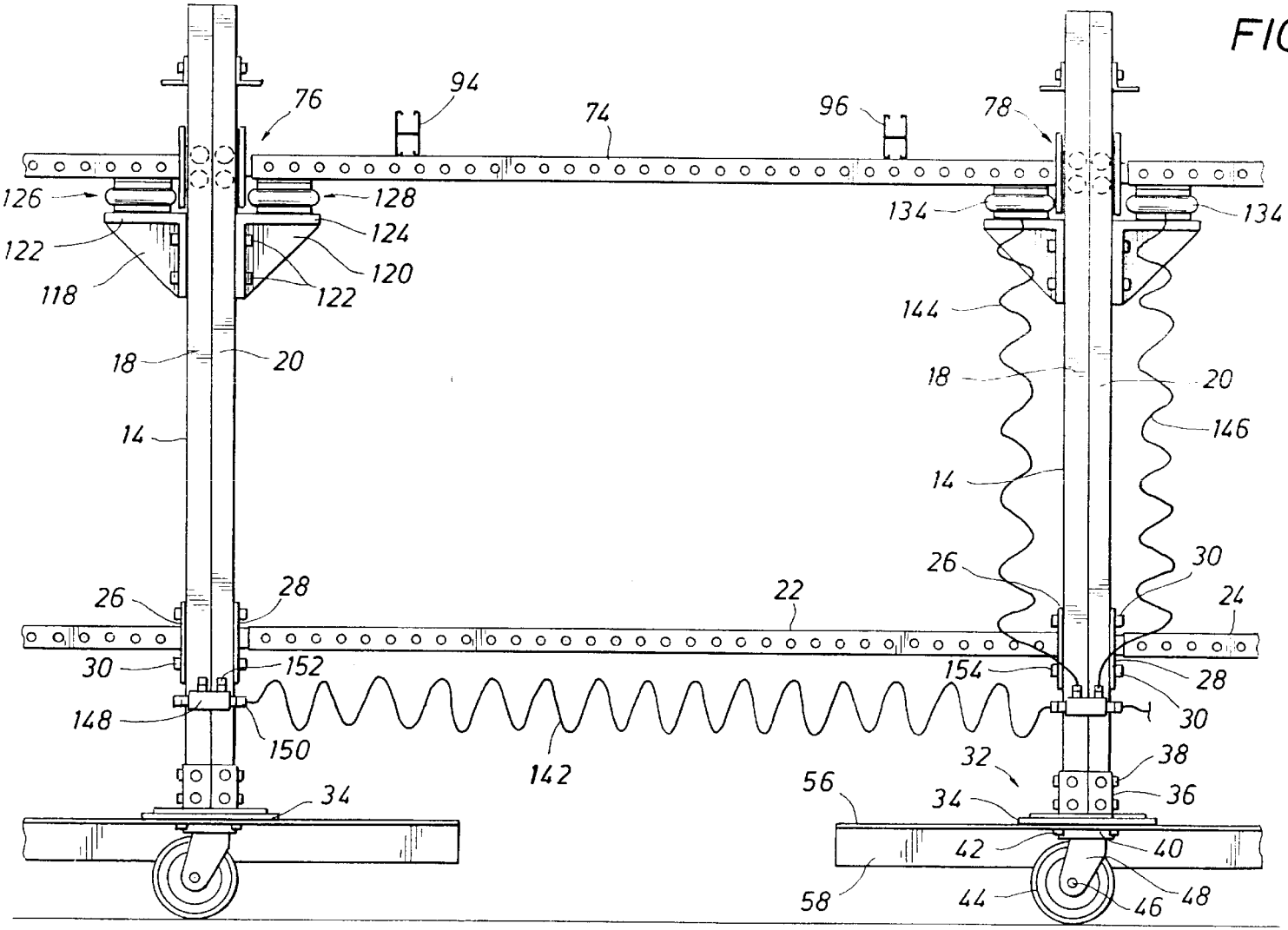
FIG. 3 is a side elevational view showing one section of the shelving lift and movement system of FIG. 2 and illustrating the components thereof in greater detail.

As shown in the elevational view of FIG. 3, each of the shelving lift and movement units 12 includes a pair of vertically oriented lifting posts 14 and 16, each defining a pair of internal guide channels 18 and 20. Adjacent horizontal structural members 22 and 24, each have end connection plates 26 and 28 that enable connection of the structural members 22 and 24 to the respective lifting posts 14 by means of a plurality of mounting bolts 30. To promote adjustability, the horizontally structural members 22 and 24 may be of any suitable length or they may be composed of connected lengths of material typically bolted or otherwise secured in assembly for a typical shelving lift and movement device. Preferably, each horizontal structural element 22 or 24 is made up of sections that are bolted together, using selected ones of multiple holes formed therein to provide for adjustment of the length of the horizontal structural member to accommodate the dimension of the shelving to be lifted and moved. The centerline distance between lifting posts 18 may be in the order of 64½ inches for a particular embodiment of the invention. This centerline distance, however, will depend upon the width of the shelving units that are being lifted and moved and may be adjusted to be less or greater to accommodate the dimension of the shelving.

At the lower ends of each of the lifting posts 14 is provided a roller assembly, shown generally at 32, which comprises a roller support plate 34 having an upperly projecting connection structure 36 which is secured to the lower end of the lifting posts by means of a plurality of mounting bolts 38. The connection structure 36 may be welded or otherwise connected to the roller support place 34. A caster or roller mount 40 is fixed to the roller support plate 34 by a plurality of roller mounting bolts 42 as shown. A roller 44, preferably a caster roller is mounted for rotation by a roller spindle 46 which extends through registering roller support openings of a caster or other roller support member 48. When casters are employed as the support and movement rollers of the shelving lift and movement system, the caster support 48 will be mounted to the roller mounting plate 40 by means of a suitable bearing assembly. As shown particularly in FIG. 6, the roller support plate 34 is shown to be a rectangular structure having sets of roller mount openings, such as shown at 50 and 52 to thereby enable the casters or rollers to be suitably located on the roller mounting plate to accommodate the width of the shelving that is being lift. a pair of angle members 54 and 56 are mounted by bolts 58 to the roller mounting plates 34. As shown these angle members are positioned such that flanges 60 and 62 thereof are oriented vertically and are thereby adapted for stabilizing engagement with the kick plates that are typically provided on opposite sides of conventional shelving.

Figure 6:
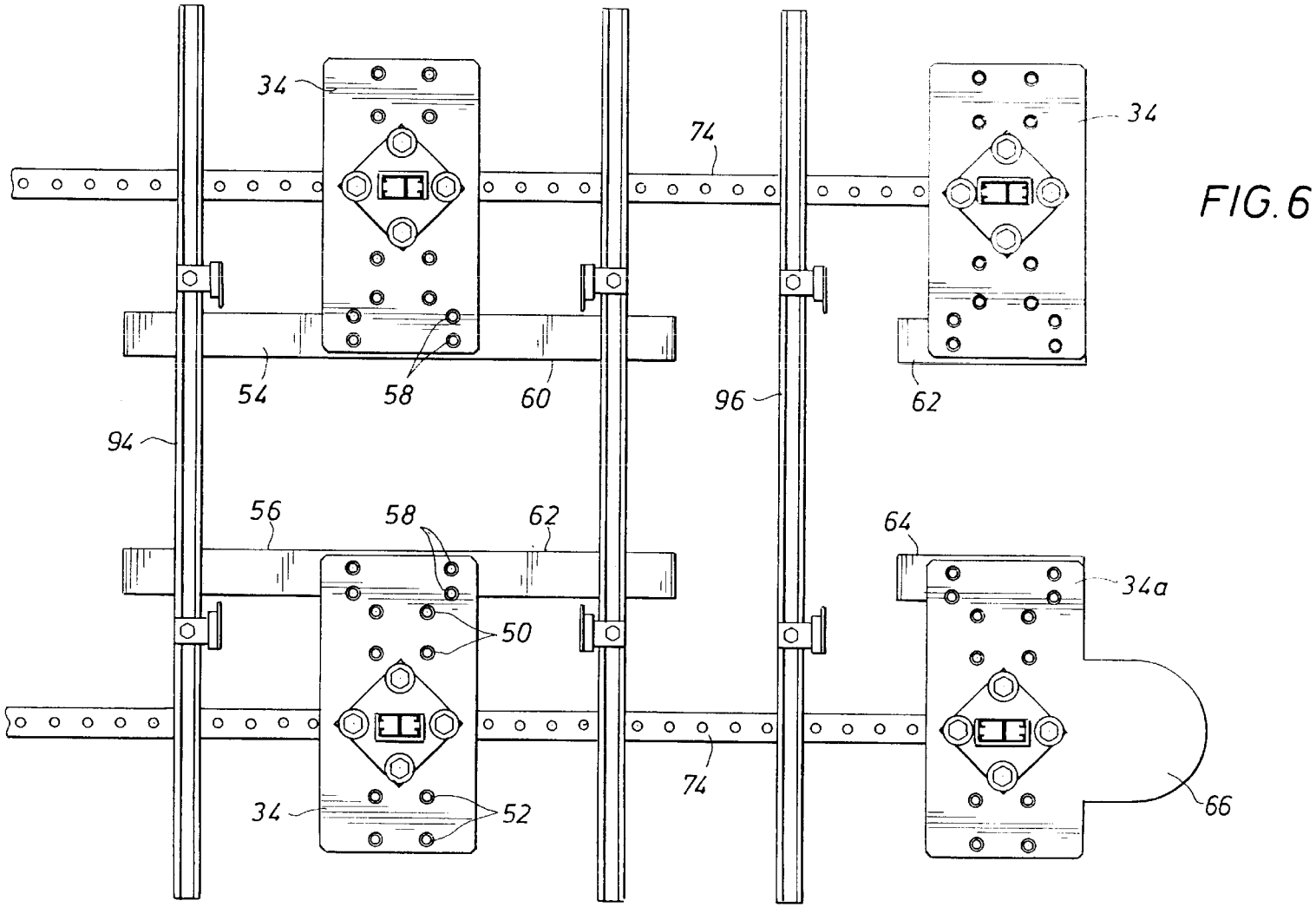
FIG. 6 is a plan view showing right end section of the shelving lift and movement system of FIG. 1, with components thereof being shown in greater detail.

At the ends of the shelving lift and movement system such as shown at the right-hand portion of FIG. 6, roller mounting plates may be provided such as shown at 34 and 34*a*. The mounting plate 34 is shown to be identical as compared to the mounting plates 34 of the adjacent modular lift and movement unit. the only difference is that the angle members 62 and 64 are of different length as shown. Additionally, the roller mounting plate 34*a* is provided with a support projection 66 to provide support for a pressurized gas bottle 68 shown in FIG. 2 The pressurized gas bottle, typically containing nitrogen, is utilized to provide a pressurized gas energized motive force for simultaneously actuating a plurality of pneumatic lift units in the manner to be described blow. The pressurized gas bottle 68 is provided with an appropriate gas pressure regulator 70 and an actuating valve 72. The actuating valve will typically have a lifting position causing pressurized gas to be simultaneously communicated to all of the lifting units for simultaneous and even lifting of an entire run of loaded shelving and will typically have a lowering position permitting gas pressure to bleed from the lifting units so that the run of shelving can be gently lowered to the floor after the shelving has been properly positioned.

Movable horizontally oriented structural members 74 are located between adjacent lifting posts 14 and are of adjustable length so that the distance between adjacent lifting posts can be adjusted according to the dimension of the individual shelving units that make up the run of shelving. If desired the vertically movable structural members 74 may be of various length and suitable lengths of structural material may be employed according to the dimension of the shelving to be lifted and moved. Preferably, each horizontal structural element 74 is made up of sections that are bolted or otherwise fixed together when a desired overall length has been established, by placing bolts or other connectors in selected ones of multiple holes formed therein. This feature provides for adjustment of the length of the horizontal structural member to accommodate the dimension of the shelving to be lifted and moved.

As the structural members 74 are lifted or lowered while supporting the weight of the shelving, it is desirable to guide the structural members and to ensure that they remain substantially horizontal during lifting and lowering movement thereof To permit guidance of the structural member 74 as they are moved vertically, a pair of guide assemblies shown generally at 76 and 78 are connected to respective ends of the structural elements 74 and are provided with guide rollers that are received within the respective internal guide chambers 18 and 20 of the respective lifting posts 14. The guide assemblies are best s in the enlarged partial elevational view of FIG. 5.

Each of the guide assemblies incorporates a guide projection 80 that is secured in assembly within the tubular structural member 74 such as by means of bolts, pins or any other suitable connectors. The guide projection extends from a guide plate member 82 which is oriented in generally parallel relation with the respective lifting posts. From the guide projection extends a generally rectangular roller mounting projection 84 which projects through the respective parallel slot 19 or 21 as the case may be. Upper and lower pairs of guide rollers 86 and 88 are mounted to the roller mounting projection 84 by respective roller mounting pins 90 and 92, which serve as spindles for roller support. Thus, as the structural element 74 is moved upwardly or allowed downwardly during lifting or lowering of shelving, the guide rollers 86 and 88 provide for smooth structural element actuation thus permitting it to remain horizontally oriented during such movement.

Figure 4:
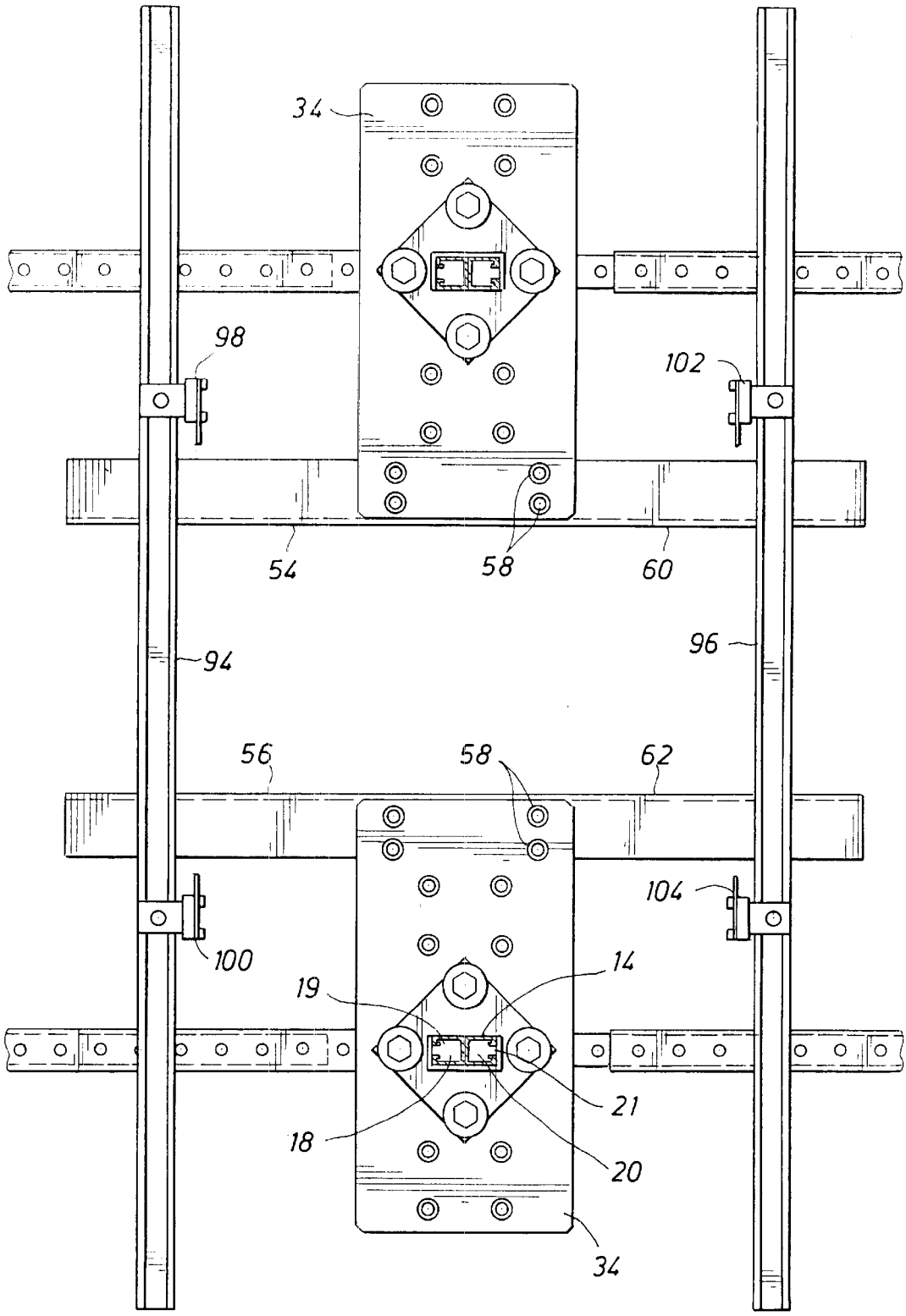
FIG. 4 is a plan view showing one of the sections of the shelving lift and movement system of FIG. 1 with components thereof being shown in greater detail.

A pair of horizontal structural elements 94 and 96 are positioned in transverse relation and in supportive engagement with the moveable horizontal structural element 74 as shown best in FIG. 3. Each of the transverse elements 94 and 96 is provided with a pair of shelf engaging members. As shown in FIG. 4, shelf engaging or stabilizing members 98 and 100 are shown in assembly with horizontal structural member 94 while shelf engaging members 102 and 104 are shown to be in assembly with horizontal structural element 96. These shelf engaging members establish stabilizing support with upper sections of the shelving to be lifted and moved to thereby ensure that the shelving remains essentially stable and does not tend to fall over during its lifting and movement.

Figure 5:
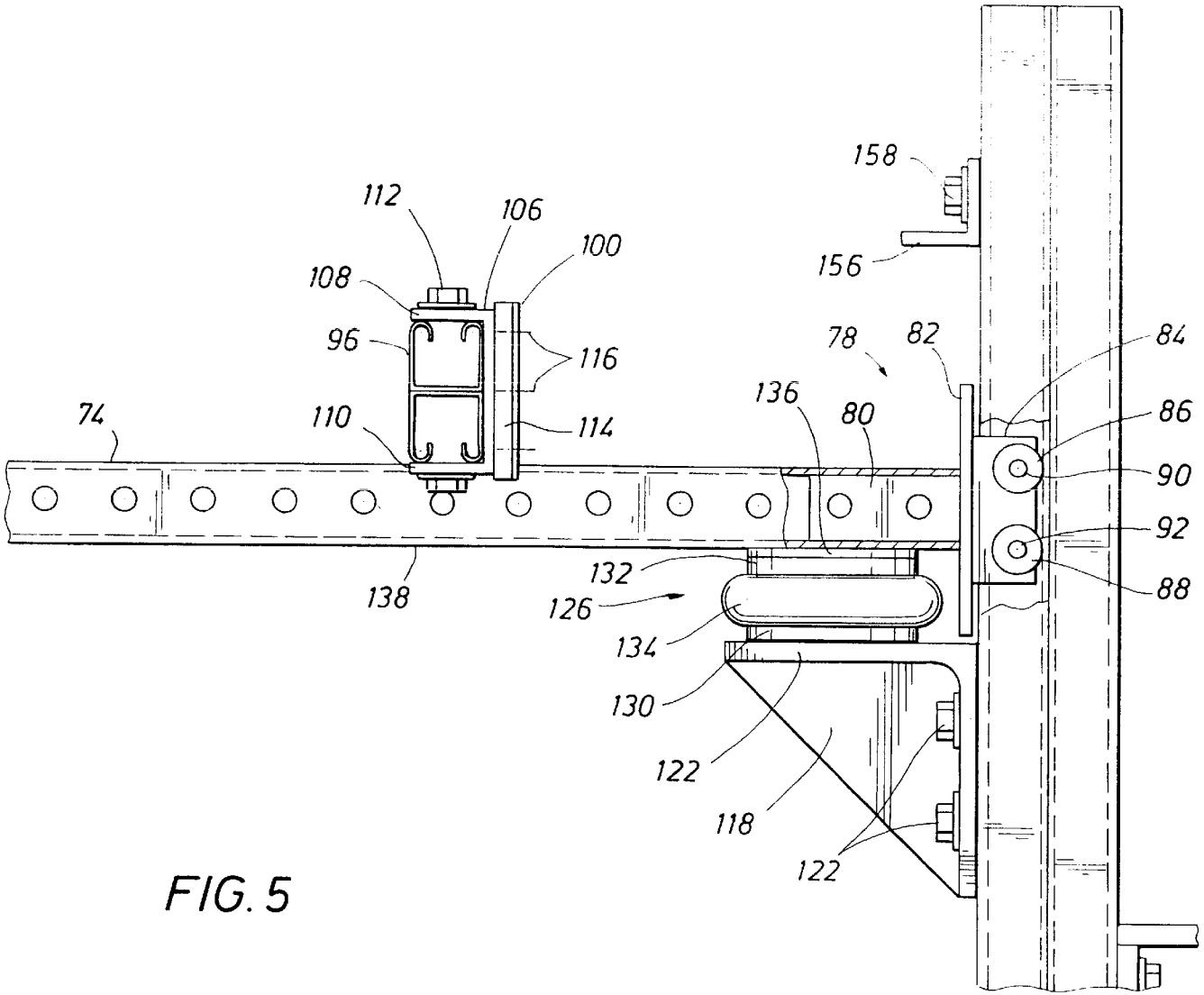
FIG. 5 is a partial elevation view showing a part of the right end section of the shelving lift and movement system of FIG. 1, again with components thereof being shown in greater detail.

As shown in detail in FIG. 5, each of the shelf engaging members includes a C-type clamp member 106, having upper and lower clamping flanges 108 and 110 is secured in clamping engagement with the horizontal structural element 96 by means of clamping bolts 112. To the C-type clamp member 106 is mounted a structural plate 114 having a plurality of shelf engaging projections 116 which are simply shown by lines, but which may take any suitable form for establishing substantially interlocking engagement with structural components of the shelving. The respective clamp members 106 are suitably adjusted so that they establish intimate stabilizing engagement with the shelving structure. At times, the shelving will incorporate openings, slots or other structural components. These shelf engaging projections 116 will engage the structural components and establish intimate stabilizing relation with the shelving structure.

For the purpose of lifting the shelving, each of the vertically oriented lifting posts 14 will be provided with a pair of support brackets such as shown at 118 and 120, which are secured to the lifting posts by means of bolts 122. The lifting posts 14 are preferably perforated at evenly spaced locations along the length thereof, so as to define multiple bolt holes through which the mounting bolts 122 may extend. This feature enables the lift support brackets 118 and 120 to be positioned at selected locations along the length of the lifting posts so that the lifting elements may be located at any suitable height with respect to the floor surface on which the run of shelving is supported. Thus, the lifting devices can be located from about 12 inches above the floor surface to about 60 inches or more above the floor surface or any location in between to thereby enable the lifting and movement apparatus to be adjustable or adaptable for lifting and moving a wide variety of shelving types. The support brackets are oriented to provide horizontally oriented support plates or platforms 123 and 124 which provide support for respective lifting elements such as shown generally at 126 and 128.

As shown in the enlarged detailed view of FIG. 5, the lifting elements are preferably in the form of pneumatic lifting elements having a lower lifting plate 130, which rests on the support plate or platform 123 and an upper lifting plate 132. Between the upper and lower lifting plates, the lift assembly 126 is provided with an expandable and contractable lifting bladder 134, which is composed of flexible material such as rubber or any similar gas impervious material and defines an upper lifting wall and a lower supporting wall structure. The expandable and contractable lifting bladder 134 is typically expanded by air pressure or the pressure of any other suitable fluid of gaseous or liquid character to provide the upper lifting plate 132 with upper movement. Typically, a lifting plate 136 will be located between the upper lifting plate 132 and the lower surface 138 of the horizontal movable structural element 74. As a gas or liquid is injected into the internal chamber of the bladder 134 under pressure, an upward force is imparted by expansion of the bladder thereby driving the plate members 132 and 136 upwardly and imparting a lifting force to the horizontal structural element 74 thereby moving it upwardly. This upward movement of the horizontal structural element, because of its intimate lifting relation with the shelving, imparts a lifting force which lifts the shelving from the floor surface so that it is supported on the casters or rollers of the lifting and movement system for the shelving. It should be borne in mind that the shelving only need lifting in the order of from one to two inches from the floor to thus enable it to be moved along the floor on the rollers of the apparatus. However, even and simultaneous lifting of the shelving is necessary to ensure that the shelving and its contents are not damaged or disturbed during lifting, movement or lowering activity.

As mentioned above in connection with FIG. 2, a bottle 68 of pressurized gas is supported at one end of the shelving lifting and movement system. The outlet of the regulator and control valve 70 and 72 is connected to a fluid pressure supply line 140 which is in communication with a manifold supply line 142. Individual supply lines such as shown at 144 and 146 extend from the manifold supply line 142 and establish fluid connection with respective ones of the expandable and contractable lifting bladders 134, essentially as shown in FIG. 3. As shown in FIG. 3, the manifold supply line 142 is defined by a flexible spiral configured supply line that is capable of extension and contraction depending upon the particular spacing of the adjacent lifting posts. Likewise, the individual supply lines 144 and 146 are also defined by flexible, spiral wound supply hose which permit adjustment of the vertical height of the lifting post members to suit the particular shelf lifting and movement project that is being done. For modular connection purposes, hose connector blocks 148 are mounted in any suitable fashion to the lower portions of the respective lifting posts. These connection blocks define internal fluid channels and also define hose connections that receive the respective supply hose connectors 150 and individual hose connections 152 and 154. The upper ends of the individual supply hoses penetrate the respective support plate or platform 123 or 124 and establish fluid communication with the internal chamber of the respective expandable and contractable lifting bladder.

It should be borne in mind that lifting of the shelving a distance from about one inch to about two inches is sufficient to permit movement of the shelving along a floor surface. Thus, the bladder element 134 need only to expand sufficiently to accommodate a lift of from one to two inches. To ensure that excess lifting does not occur, lifting stops 156 are secured to the lifting posts 14 by bolts 158. Thus, lifting can only occur to the point that the upper end of the plate member 82 establishes contact with the lifting stop member 156.

In operation a suitable number of modular shelving lifting units are positioned in assembly with each of the plurality of shelving units that make up a run of shelving. Any suitable number of modular lifting and movement units may be assembled to accommodate the length of the run of shelving that is to be lifted from the floor surface and moved to a desired location. The apparatus is adjusted so that the shelf engaging projections 116 establish intimate engagement is with the upper portion of the shelving. The lifting apparatus is also adjusted or otherwise positioned so that the lower shelving engaging members 54 and 56 essentially engage the kick plate structure of the shelving and thus provide for stabilization of the run of shelving when it is lifted from the floor surface. After this has been done, the user of the apparatus will simply open the valve of the pressurized gas supply bottle thereby communicating pressurized gas, at a pressure regulated by the gas regulator, to be communicated into the internal gas chamber of each of the lifting devices, causing all of the expandable and contractable bladders to expand simultaneously so that simultaneous lifting of each of the individual shelving units of the run of shelving occurs. Pressurized gas is introduced until such time that the shelving has been lifted from one to two inches above the floor surface so that the lifting apparatus and the shelving is supported on the casters or wheels 44. This will then allow the entire run of shelving which has been lifted to be rolled on the casters or rollers to a suitable location. Typically, one or two workers will simply push and guide the lifted run of shelving until the desired location thereof has been achieved. When the shelving lifting and movement system is utilized during carpet or flooring replacement or repair services, the run of shelving is typically moved along the floor surface to an out-of-the-way location so that the shelving will not interfere with such activity. After carpet or flooring replacement or repair services have been accomplished the lifted shelving can be returned to a desired location on the carpet or other floor surface and can then be again lowered onto the carpet or floor surface.

When lowering of the shelving is desired, the supply valve will be closed and a bleed valve will be opened, thereby allowing bleeding of gas pressure from the system. This feature allows each of the plurality of bladders to be contracted or collapsed by the weight of the shelving as the shelving settles toward or onto the floor surface. After the shelving has been desirably located in this manner, the lifting and movement apparatus of the present invention is then assembled to another run of shelving and the process is repeated until all of the runs of shelving have been lifted, moved and then returned to desired positions. The lifting and movement apparatus is then disassembled and the modular sections thereof are transported to another site for similar use.

Though the lifting and movement system of the present invention is discussed herein particularly as it relates to the lifting and movement of shelving, particularly loaded shelving, such discussion is not intended to limit the scope of the invention in any manner whatever. The lifting and movement system of the present invention may be efficiently utilized for lifting and movement of other structures and apparatus without departing from the spirit or scope of the present invention.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A lifting and movement system for a run of shelving having a plurality of shelf units disposed in side-by-side relation, comprising:

a first frame structure having sufficient length to extend along the run of shelving, said first frame structure having a plurality of lifting posts each being interconnected in substantially fixed relation with said first frame structure and defining at least one internal guide channel and defining a longitudinal slot opening said internal guide channel and having a plurality of lift supports mounted thereto for substantially vertical adjustment and being selectively positioned thereon;

a plurality of wheels mounted to said first frame structure for support of said lifting and movement system on a floor surface and for movement of said lifting and movement system and the run of shelving along the floor surface;

a second frame structure being in substantially vertically movable assembly with said plurality lifting posts of said first frame structure and adapted for lifting engagement with the run of shelving, said second frame structure having a pair of substantially horizontally oriented structural elements defining ends and having load transferring relation with a run of shelving to be lifted and moved and having guide wheel elements extending from said ends of said substantially horizontally oriented structural elements and being located within said internal guide channels of adjacent lifting posts;

a plurality of lift elements each being supported by one of said plurality of lift supports of said first frame structure and providing lifting, lowering and support for said second frame structure relative to said first frame structure; and a lift power system being in controllable relation with each of said plurality of lift elements and being selectively actuatable for simultaneously activating each of said plurality of lift elements for lifting or lowering of said second frame structure relative to said first frame structure and thereby lifting or lowering the run of shelving.

2. The lifting and movement system of claim 1, comprising:

said plurality of lift elements being fluid pressure energized bladder type lift elements each having an internal chamber and being expandable upon introduction of pressurized fluid from said pressurized fluid supply into said internal chamber and contractible upon bleeding of pressurized fluid from said internal chamber; and said lift power system being a controllable pressurized fluid supply in fluid supplying communication with each of said plurality of fluid pressure energized bladder type lift elements and having an actuator being selectively positionable for introduction of fluid pressure into said internal chamber of each of said plurality of fluid pressure energized lift elements for load lifting expansion thereof and being selectively positionable for simultaneously bleeding fluid pressure from each of said plurality of fluid pressure energized bladder type lift elements for load lowering contraction thereof.

3. The lifting and movement system of claim 1, comprising:

said plurality of lift elements being pneumatic pressure energized bladder type lift elements each having an internal chamber and being expandable upon introduction of pressurized gas into said internal chamber and contractible upon bleeding of pressurized gas from said internal chamber; and said lift power system being a controllable pressurized gas supply being supported by said first frame structure and being in gas supplying communication with each of said plurality of pneumatic pressure energized bladder type lift elements and having an actuator being selectively positionable for introduction of pressurized gas from said gas supply into said internal chamber of each of said plurality of pneumatic pressure energized bladder type lift elements for load lifting expansion thereof and being selectively positionable for simultaneously bleeding gas pressure from each of said plurality of pneumatic pressure energized bladder type lift elements for load lowering contraction thereof.

4. The lifting and movement system of claim 3, comprising:

said plurality of pneumatic pressure energized bladder type lift elements each being composed of flexible material and defining upper and lower force transmitting walls and having an internal gas chamber in selective gas receiving and bleeding communication with said controllable pressurized gas supply; and upper and lower lifting plates being in contact respectively with said upper and lower force transmitting walls, said lower lifting plate being supported by one of said lift supports and said upper lifting plate having supporting engagement with said second frame structure and transferring lifting force from said upper force transmitting wall to said second frame structure.

5. The lifting and movement system of claim 1, comprising:

said first and second frame structures each being of adjustable height, length and width to accommodate dimensional variations of the shelving units of the run of shelving to be lifted and moved.

6. The lifting and movement system of claim 1, comprising:

said lift supports each being in vertically adjustable assembly with one of said lifting posts for supporting an individual one of said plurality of lift elements and being selectively vertically positionable on said lifting post to provide for selective elevation of said plurality of lift elements to accommodate the dimension and geometry of the run of shelving to be lifted and moved.

7. The lifting and movement system of claim 1, comprising:

a plurality of frame modules defining said first and second frame structures and being interconnected to accommodate the length of the run of shelving to be lifted and moved.

8. The lifting and movement system of claim 1, composing:

said plurality of lift supports each being selectively vertically positionable on said lifting posts for adjustably locating said plurality of lift elements at desired elevation for the run of shelving to be lifted and moved.

9. The lifting and movement system of claim 1, comprising:

said plurality of wheels being wheel assemblies having wheel mounting structure connected to respective ones of said lifting posts; and caster elements being supported by said wheel mounting structure and establishing rolling support for said lifting and movement system and the run of shelving being supported thereby.

10. The lifting and movement system of claim 9, comprising:

shelving stabilizing elements being supported by said wheel mounting structure for stabilizing engagement with lower structure of the run of shelving being lifted and moved.

* * * * *

UNITED STATES PATENT AND TRADEMARK OFFICE

CERTIFICATE OF CORRECTION

PATENT NO. : 6,460,827 B1
DATED : October 8, 2002
INVENTOR(S) : David A. Baucom

It is certified that error appears in the above-identified patent and that said Letters Patent is hereby corrected as shown below:

Column 5,
Line 2, delete “a”, insert -- A --
Line 13, delete “. the”, insert -- . The --
Line 50, delete “thereof to”, insert -- thereof. To --

Column 9,
Line 12, after “opening”, insert -- to --

Signed and Sealed this

Eighteenth Day of February, 2003

JAMES E. ROGAN
*Director of the United States Patent and Trademark Office*